US006206056B1

(12) United States Patent
Lagache

(10) Patent No.: US 6,206,056 B1
(45) Date of Patent: Mar. 27, 2001

(54) FILL LIMITER FOR A LIQUID STORAGE TANK

(75) Inventor: Roland Lagache, Lege (FR)

(73) Assignee: Lafon Production S.A. (FR)

( * ) Notice: Subject to any disclaimer, the term of this patent is extended or adjusted under 35 U.S.C. 154(b) by 0 days.

(21) Appl. No.: 09/478,274

(22) Filed: Jan. 5, 2000

(30) Foreign Application Priority Data

Nov. 1, 1999 (FR) ..... 99 00195

(51) Int. Cl.[7] ..... B65B 1/30
(52) U.S. Cl. ..... 141/198; 141/212; 141/213
(58) Field of Search ..... 141/198, 95, 212, 141/213; 137/422, 429, 413, 446, 434, 447, 448; 251/77, 308, 263

(56) References Cited

U.S. PATENT DOCUMENTS

| | | | | |
|---|---|---|---|---|
| 1,289,490 | | 12/1918 | Lundstrom . | |
| 1,689,066 | | 10/1928 | Baxter . | |
| 2,299,360 | * | 10/1942 | Tharp . | |
| 4,541,464 | * | 9/1985 | Christiansen | 141/198 |
| 4,667,711 | | 5/1987 | Draft . | |
| 4,998,571 | * | 3/1991 | Blue et al. | 141/198 |
| 5,174,345 | * | 12/1992 | Kesterman et al. | 141/198 |
| 5,388,622 | | 2/1995 | Phillips | 141/198 |
| 5,398,735 | * | 3/1995 | Lagache | 141/198 |
| 5,427,137 | * | 6/1995 | Bowen | 141/198 |
| 5,518,024 | | 5/1996 | Weeks | 137/420 |
| 6,026,841 | * | 2/2000 | Kozik | 141/198 |

FOREIGN PATENT DOCUMENTS

| | | |
|---|---|---|
| 0312320 | 4/1989 | (EP) . |
| 2675476 | 10/1992 | (FR) . |

* cited by examiner

*Primary Examiner*—Steven O. Douglas
*Assistant Examiner*—Khoa Huynh
(74) *Attorney, Agent, or Firm*—Ostrolenk, Faber, Gerb & Soffen, LLP

(57) ABSTRACT

It is of the type comprising a body of vertical axis and arranged at least partially in the tank, an interior partition being mounted in the body and delimiting a passageway for the liquid and a chamber to house a float, a valve mounted above the passageway and the float chamber, the valve being capable of moving between an open position and a closed position, and a valve seat, the said float being moved vertically by the rise of the liquid in the tank and acting on the valve via operating means comprising an operating rod, the lower end of which is secured to the float, the other end of the operating rod comprises a ball moving in a groove formed in part of the valve.

8 Claims, 3 Drawing Sheets

FILL LIMITER FOR A LIQUID STORAGE TANK

BACKGROUND OF THE INVENTION

The present invention relates to a fill limiter for a liquid storage tank.

It is known practice for an underground or overground storage tank intended to contain a liquid to be fitted with a fill limiter, the function of which is to interrupt the filling of the tank when the liquid in the said tank reaches a predetermined level, so as to prevent overflow which would be harmful to the environment of the tank. This is especially sought after when the tank that is to be filled is located at a filling station delivering hydrocarbon fuels of various types.

Limiters with the simplest structure comprise a body, a valve mounted in the said body and able to move between an open position corresponding to the filling of the tank and a closed position corresponding to the interruption of the filling of the said tank; a float, connected to the said valve, accompanies the rise of the liquid in the tank so as to close the valve when the liquid in the tank reaches a predetermined level.

Numerous improvements have been made to limiters according to whether the storage tanks are fitted with manholes or inlet orifices for positioning limiters inside the storage tank.

In U.S. Pat. Nos. 1,289,490 and 1,689,066, limiters comprise a tube body equipped with an internal partition for delimiting two adjacent chambers placed side by side, one of the chambers acting as a passage for the liquid intended to fill the tank and the other housing a float which is connected to a valve capable of moving from an open position corresponding to a low liquid level in the tank, below the float, to a closed position corresponding to a high liquid level in the tank, the liquid still being below the shut-off valve. The re-opening of the valve in this prior art is still performed manually. What is more, and this is a serious disadvantage, there is no possibility of re-opening the valve when the official performing the filling operation does not interrupt filling while the valve is in the closed position.

Other limiters have recently been proposed. Such limiters are described, for example, in French Patent No. 89/16604, European Patent No. 0,312,320 and U.S. Pat. No. 4,667,711.

Each one of the limiters described in these patents comprises a float which is connected to the valve in such a way that as the liquid in the tank rises it is moved away from the body of the limiter. When the limiter is introduced into the tank inlet orifice, the float is housed at least partially in the body so as to reduce the size of the limiter.

However, such limiters, because the float travel is on the outside of the body, are not able to allow the tank to be completely filled. This is because it is necessary to keep a minimum space between the upper wall of the tank and the maximum raised position of the float.

FR-B-2,675,476 describes a fill limiter comprising a float moving vertically in a chamber formed in the body of the limiter, a valve which can move between a vertical open position and a horizontal closed position, the float being connected to the valve by means of a linkage which collaborates with a pawl for retaining the valve in the vertical open position, a deflector consisting of inclined blades being arranged above and a certain distance away from the valve. There is a return spring for returning the valve to the vertical open position when the force exerted by the column of liquid on the said valve is lower than the return force exerted by the spring.

The main drawback of this limiter lies in the complexity of the valve-operating means mounted between this valve and the float. What is more, it is necessary to precisely determine the distance separating the free end of the rod connected to the float from the pawl which catches on the valve. Now, too short a distance leads to untimely closure of the valve when the fluid has not reached the desired level in the tank; too great a distance leads to late closure of the valve.

Another drawback lies in the fact that it is necessary to design the valve return spring to be relatively weak so as to allow the valve to close for low deliveries of fluid, for example up to 15 $m^3$. However, in this case, the re-opening of the valve becomes difficult because of the weakness of the return spring.

SUMMARY OF THE INVENTION

The object of the present invention is a limiter of the type described in FR-B-2,675,476 but which has a far simpler structure and operates far more reliably.

The subject of the present invention is a fill limiter of the type comprising a body of vertical axis and arranged at least partially in the tank, an interior partition being mounted in the said body and delimiting a passageway for the liquid and a chamber to house a float, a valve mounted above the passageway and the float chamber, the said valve being capable of moving between an open position and a closed position, and a valve seat, the said float being moved vertically by the rise of the liquid in the tank and acting on the said valve via operating means comprising an operating rod, the lower end of which is secured to the float, and it is characterized in that the other end of the operating rod comprises a ball moving in a groove formed in part of the valve.

One advantage of the present invention lies in the fact that the vertical float is constantly connected to the valve both in the open and the closed position. The use of a valve of the butterfly type which is known per se makes it possible to reduce the travel of the operating rod connected to the float.

Another advantage is that at every instant and as soon as the float moves upwards, there is a rotational movement of the valve in the stream of liquid until the valve is completely closed, and this is true regardless of the throughput of fluid in the limiter.

BRIEF DESCRIPTION OF THE DRAWINGS

Other advantages and features will become clearer on reading the description of one preferred embodiment of the invention and on studying the appended drawings, which.

DESCRIPTION OF THE PREFERRED EMBODIMENT

Figure 1:
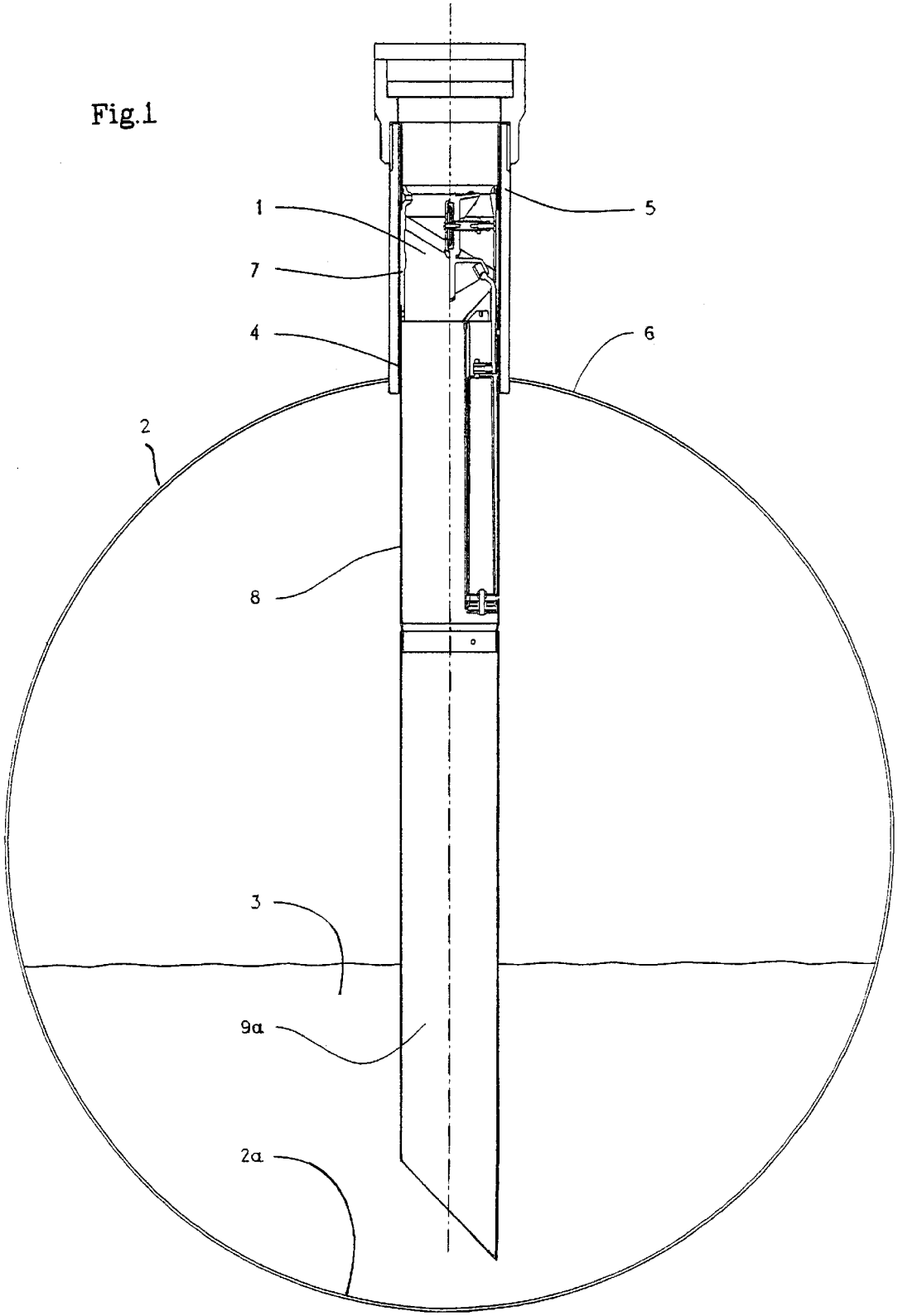
FIG. 1 is a view in section of a storage tank fitted with a limiter according to the present invention.

The fill limiter 1 according to the present invention is intended to be fitted in a storage tank 2 for storing a liquid 3 such as a hydrocarbon, the tank 2 being equipped, for example, with an orifice 4 delimited by the internal section of an inlet tube 5 secured to the upper wall 6 of the tank 2 (FIG. 1).

The fill limiter 1 comprises a body 10 of vertical axis consisting of two parts, an upper part 7 and a lower part 8, sealing between the upper and lower parts being obtained by any appropriate means such as a mastic. The lower part 8 has a narrowed end 9 designed possibly to take an extension tube 9*a*, the lower end of which is relatively close to the bottom wall 2*a* of the tank 2.

Figure 2:
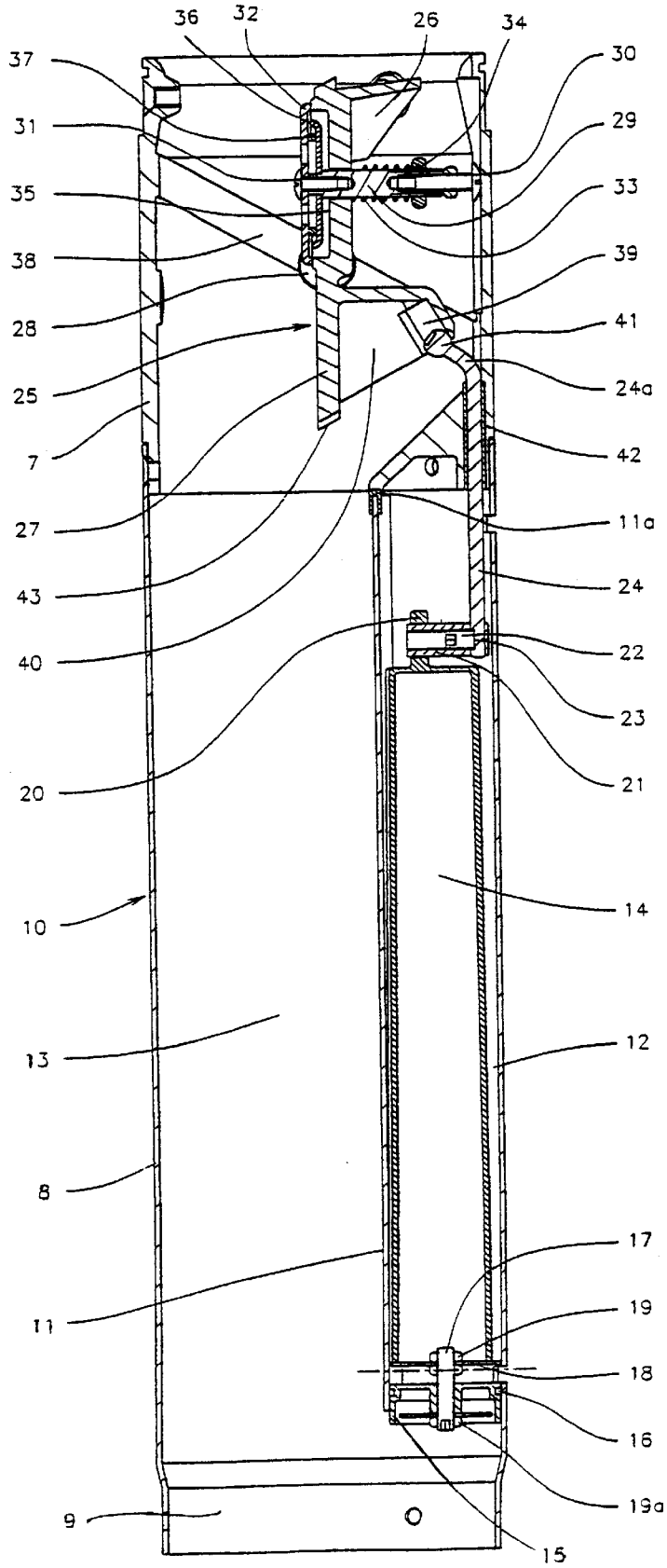
FIG. 2 is a view in section of the limiter according to the invention.

Located in the lower part 8 of the body of the limiter 10 is a partition 11 which delimits two chambers 12 and 13 (FIG. 2). The partition 11 is fitted with a seal in the form of a lip 11*a* which provides sealing between the body 7 and the said partition 11. The chamber 13 delimits a passageway for the fill fluid. A hollow float 14, made of an appropriate substance such as polyamide well known to those skilled in the art, is mounted in the chamber 12 which is closed by a stopper 15. The stopper 15 is fitted with an O-ring 16 and a headless screw 17 passes through it. A bearing washer 18 is mounted on the screw 17 and is held in position by means of two nuts 19. The washer 18 constitutes a stop for the float 14 and determines the lowermost position of the float 14 and is adjusted heightwise by means of the said screw 17 and locked by a nut 19*a*. The float 14 comprises, at the upper part, an appendage or small rod 20 with an oblong orifice in which a finger 21 is mounted. A screw 22 is arranged in the finger 21 and bears against a flat 23 formed at the lower end of an operating rod 24 which passes through the finger 21. The screw 22 secures the operating rod 24 to the float 14 via the finger 21 and the appendage 20. The operating rod 24 has a curved part 24*a* providing continuity between the straight part and a ball 41 which constitutes the opposite end to the end which is secured to the finger 21.

A valve 25, of the butterfly valve type, is mounted in the upper part 7 and above the passageway 13 and the chamber 12 of the float.

The valve 25 comprises a deflector 26 which is of one piece with the valve body 27 which is mounted about a pivot axis 28. Mounted on the valve body 27 is a rod 29, the ends of which are tapped, one of them to take a stop screw 30 and the other to take a screw 31 for holding a pressure-relief valve 32. A spring 33 is mounted on the rod 29 and rests via one end against the valve body 27 and via the other end against a nut 34 which is positioned on the said rod 29 so as to give the said spring 33 a predetermined preload. The valve body 27 comprises a drainage chamber 35 in which is mounted a drainage valve 36 urged into an open position by a return spring 37 bearing against the pressure-relief valve 32. Orifices, not depicted, are formed in the valve body 27 and in the pressure-relief valve 32.

Figure 3:
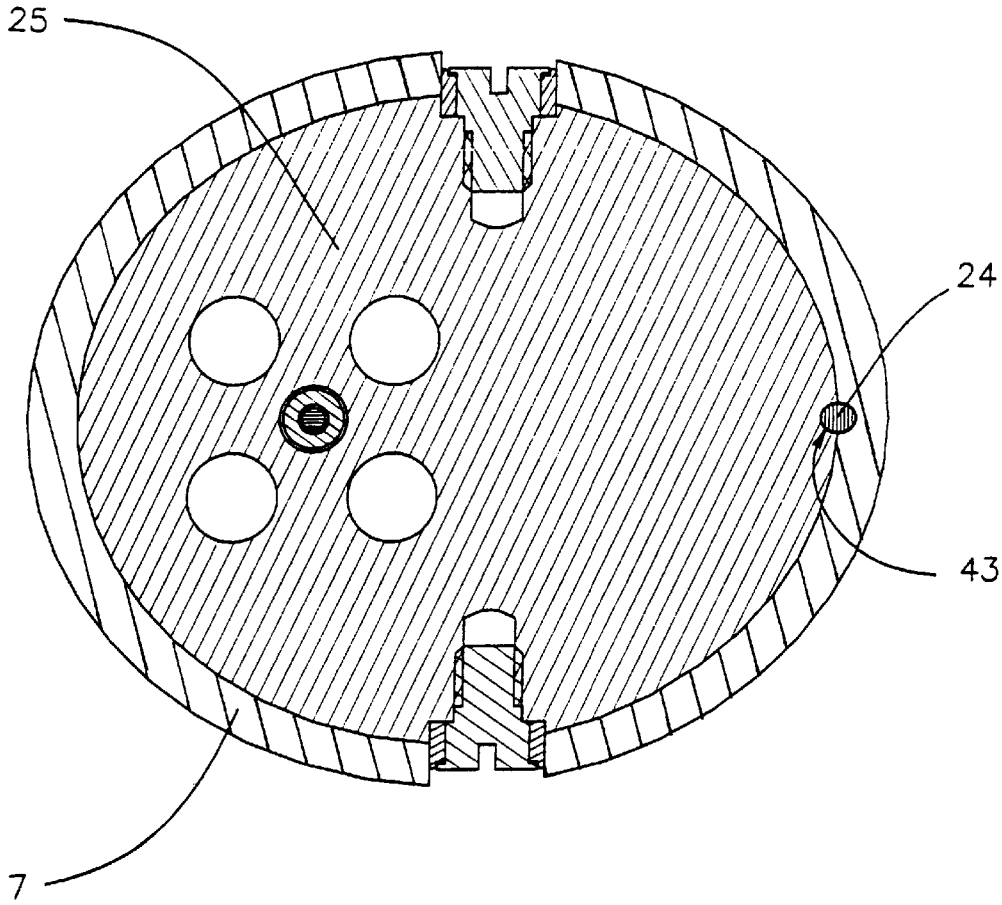
FIG. 3 is a cross sectional view of the upper part of the fill limiter.

A cylindrical groove 39 is formed in part of the valve body 27, the said part consisting, for example, of a connecting tab 40 made of one piece with the body 27. Inside the groove 39 which is about 15 mm long there moves a ball 41 with a diameter of about 8 mm which constitutes one end of the operating rod 24, the diameter of which is approximately 4 mm. This rod slides in a passage 42 in the interior wall of the upper part 7 of the body of the limiter 10. A slot 43 is formed on one side of the valve body 27 and partially houses the operating rod 24 when the valve 25 is in the closed position resting on the inclined seat 38 as shown in FIG. 3.

The interior wall of the passage 42 is preferably coated with a lubricating substance such as graphite so as to reduce the friction of the rod 24 on the upper body 7.

The angle that the cylindrical groove 39 makes with respect to the vertical axis of the limiter is between 15 and 25° and is preferably equal to 20°. The axis of the rod, not depicted, lies in the cylinder where the valve seat 38 and the valve 25 meet, so as to reduce internal leakages as far as possible.

The dimensions quoted hereinabove relate to a limiter with a diameter of 97 mm, but it goes without saying that the said dimensions will be adapted to suit those of the limiter.

The way in which the limiter according to the present invention works is as follows.

When fluid is let into the limiter, the valve 25 is in the wide-open position, more or less in a vertical position. In this wide-open position, the assembly comprising ball 41 and groove 39 is such that the float experiences no influence which could be exerted by the throughput, even a high throughput, of fluid. The float 14 prevents any rotational movement of the valve 27 as long as it occupies the lowered position resting on the washer 18. In fact, the ball 41 in the groove 39 constitutes a locking system. When the fluid level in the tank 2 rises and approaches the float 14, the latter begins to move upwards.

For small movement of the float 14, the valve 25 rotates about its axis of rotation and is brought against the seat 38 by the fluid, thus occupying the completely closed position. It should be noted that even for relatively low throughputs, for example less than 15 $m^3$, the valve 25 is made to close because of the permanent connection between the float 14 and the valve 25.

When the valve 25 is in the closed position resting against its seat 38 which is inclined by more or less 45° to the vertical axis of the limiter, and as long as the pressure of the liquid above the seat 38 exceeds 1.5 bar, the pressure-relief valve 32 remains open, liquid discharging into the tank 2 through the orifices in the valve body 27, the drainage chamber 35 and through the space created between the valve body 27 and the pressure-relief valve 32. When the fluid pressure is below 1.5 bar, the pressure-relief valve 32 closes, coming to bear on the valve body 27. By internal leakages formed between the valve body 27 and the seat 38, the pressure can decrease further. When the fluid pressure approaches 50 mb, the drainage valve 36 opens under the action of the return spring 37, and this accelerates the drainage of the liquid from above the valve 25, the said fluid discharging into the passageway 13, through the said orifices in the valve 27, the drainage chamber 35 and the orifices of the pressure-relief valve 32.

When the liquid level in the tank 2 drops, the valve 25 is made to open simply by the weight of the totally emerged float 14, because of the permanent connection between the float and the valve.

What is claimed is:

1. Fill limiter for being introduced into an inlet orifice formed in one wall of a liquid storage tank, the limiter comprising:

a body having a vertical axis, the body having a lower region for being arranged at least partially in the tank;

an interior partition mounted in the body and delimiting a passageway for the liquid and a float chamber;

a float floatable in the float chamber;

a valve mounted above the passageway and the float chamber, the valve being capable of moving between an opened position permitting liquid to flow past the valve and a closed position; a valve seat positioned and shaped for closing the valve when the valve is in the closed position;

the float being movable vertically in the body by the rise of the liquid in the tank and the moving float acting on the valve;

operating means comprising an operating rod having a lower end which is secured to the float, the operating rod having another end comprising a ball, a groove formed in the valve for receiving the ball which moves in the groove as the float moves.

2. Limiter according to claim 1, further comprising a slot formed in the body of the limiter and the operating rod moving in the slot.

3. Limiter according to claim 1, wherein the valve comprises a slot formed on a lateral side, the slot being shaped to partially grip the operating rod when the valve is in the closed position.

4. Limiter according to claim 1, further comprising a stopper closing off the lower end of the limiter; a height-adjustable washer secured to the body and forming a bottom stop for the float.

5. Limiter according to claim 1, wherein the float has an upstanding appendage, a horizontal finger connected with the appendage, the finger having one end which is secured to the operating rod.

6. Limiter according to claim 1, wherein the valve is a butterfly valve and the seat which cooperates with the valve is inclined to the vertical axis of the body of the limiter;

a drainage chamber formed in the valve, a drainage valve in the drainage chamber, a return spring arranged in the drainage chamber and acting upon the drainage valve.

7. Limiter according to claim 1, wherein the groove is inclined to the vertical axis of the limiter by about 20°.

8. Limiter according to claim 1, wherein the operating rod comprises a straight part and a curved part which connects between the straight part and the ball.

* * * * *

UNITED STATES PATENT AND TRADEMARK OFFICE

CERTIFICATE OF CORRECTION

PATENT NO. : 6,206,056 B1
DATED : March 27, 2001
INVENTOR(S) : Roland Lagache

It is certified that error appears in the above-identified patent and that said Letters Patent is hereby corrected as shown below:

Title page,
Item [30] Foreign Application Priority Data, should read
January 11, 2000 (FR).....99 00195

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,206,056 B1
DATED : March 27, 2001
INVENTOR(S) : Roland Lagache

It is certified that error appears in the above-identified patent and that said Letters Patent is hereby corrected as shown below:

Title page,
Item [30], Foreign Application Priority Data, should read
-- January 11, 1999 (FR).....99 00195 --

Signed and Sealed this

Twenty-first Day of January, 2003

JAMES E. ROGAN
*Director of the United States Patent and Trademark Office*